US008967379B2

(12) United States Patent
Kinskey et al.

(10) Patent No.: US 8,967,379 B2
(45) Date of Patent: Mar. 3, 2015

(54) TOOL STORAGE AND TRANSPORT SYSTEM

(71) Applicant: LF Centennial Ltd., Road Town, Tortola (VG)

(72) Inventors: Terrence P. Kinskey, Alpharetta, GA (US); Matthew G. Williams, Lighthouse Point, FL (US)

(73) Assignee: LF Centennial Ltd., Road Town, Tortola (VG)

( * ) Notice: Subject to any disclaimer, the term of this patent is extended or adjusted under 35 U.S.C. 154(b) by 94 days.

(21) Appl. No.: 13/796,276

(22) Filed: Mar. 12, 2013

(65) Prior Publication Data

US 2014/0262886 A1 Sep. 18, 2014

(51) Int. Cl.
*B25H 3/02* (2006.01)
*B25H 3/06* (2006.01)

(52) U.S. Cl.
CPC ..... *B25H 3/023* (2013.01); *B25H 3/021* (2013.01); *B25H 3/06* (2013.01)
USPC ..... 206/373; 206/372; 206/349; 206/1.5; 206/499; 190/100; 190/110; 190/109; 220/528; 220/510; 220/529; 150/113; 150/116; 383/40

(58) Field of Classification Search
CPC ..... B65D 1/24; B25H 3/02; B25H 3/021; B25H 3/06; B25H 3/00; A45C 13/02; A45C 13/1023
USPC ..... 206/372, 349, 1.5, 499, 373; 190/110, 190/109, 100, 111, 108; 383/104, 40, 18, 383/14; 220/528, 510, 529; 224/191, 616, 224/585, 575, 682, 684; 150/113, 110, 105, 150/116
See application file for complete search history.

(56) References Cited

U.S. PATENT DOCUMENTS

| | | | | | |
|---|---|---|---|---|---|
| 4,250,938 | A * | 2/1981 | Siegel | 150/111 |
| 4,436,215 | A * | 3/1984 | Kleinert et al. | 220/533 |
| 5,215,205 | A * | 6/1993 | Behlman | 220/4.31 |
| 5,628,443 | A * | 5/1997 | Deutsch | 224/583 |
| 5,815,843 | A * | 10/1998 | Brillhart et al. | 2/247 |
| 5,826,719 | A * | 10/1998 | Chen | 206/373 |
| 5,887,715 | A * | 3/1999 | Vasudeva | 206/373 |
| 5,911,262 | A * | 6/1999 | Steinhart | 150/103 |
| 6,138,827 | A * | 10/2000 | Marshall | 206/373 |
| 6,213,268 | B1 * | 4/2001 | Dancyger | 190/110 |
| 6,595,604 | B1 * | 7/2003 | Peterson | 312/3 |
| 6,823,909 | B1 * | 11/2004 | Marsteller | 150/113 |
| D502,599 | S * | 3/2005 | Cabana et al. | D3/292 |
| 6,915,902 | B2 * | 7/2005 | Brouard | 206/373 |
| 6,945,442 | B2 * | 9/2005 | Godshaw et al. | 224/607 |
| 6,994,132 | B2 * | 2/2006 | Antrobus | 150/107 |
| 7,004,323 | B1 * | 2/2006 | Symonds | 206/542 |
| 7,011,241 | B2 * | 3/2006 | Godshaw et al. | 224/674 |

(Continued)

*Primary Examiner* — Mickey Yu
*Assistant Examiner* — Gideon Weinerth
(74) *Attorney, Agent, or Firm* — Duane Morris LLP; J. Rodman Steele, Jr.; Gregory M. Lefkowitz

(57) ABSTRACT

A tool storage and transport system including a tool bag body formed from a base, a first exterior wall perpendicular to the base, and a second exterior wall perpendicular to the base and opposite the first exterior wall; and a tool organizer slidably engagable with at least one of the first and second exterior walls. The tool organizer includes an organizer tray having a bottom wall, a plurality of sidewalls generally perpendicular to the bottom wall, a first end, and a second end opposite the first end. The first end is slidably engagable with the exterior wall.

18 Claims, 12 Drawing Sheets

(56) References Cited

U.S. PATENT DOCUMENTS

| | | | | |
|---|---|---|---|---|
| 7,086,437 | B1 * | 8/2006 | Michael | 150/103 |
| 7,322,470 | B2 * | 1/2008 | Brunson | 206/372 |
| 7,334,680 | B2 * | 2/2008 | Cunningham et al. | 206/372 |
| D603,169 | S * | 11/2009 | Smith | D3/319 |
| D610,808 | S * | 3/2010 | Kaddar | D3/276 |
| 7,780,051 | B2 * | 8/2010 | Godshaw et al. | 224/607 |
| 7,794,003 | B2 * | 9/2010 | Crandall | 296/37.6 |
| 7,900,757 | B2 * | 3/2011 | Sisitsky | 190/100 |
| 7,950,509 | B2 * | 5/2011 | Redzisz | 190/111 |
| D639,557 | S * | 6/2011 | Damda | D3/287 |
| D670,495 | S * | 11/2012 | Lorek et al. | D3/284 |
| 8,302,749 | B2 * | 11/2012 | Melmon et al. | 190/110 |
| 8,550,251 | B1 * | 10/2013 | Ford | 206/570 |
| 8,596,458 | B1 * | 12/2013 | Alcorn et al. | 206/581 |
| 8,651,273 | B2 * | 2/2014 | Williams et al. | 206/372 |
| 2002/0015538 | A1 * | 2/2002 | Snider | 383/18 |
| 2002/0070137 | A1 * | 6/2002 | Hedges | 206/373 |
| 2003/0000612 | A1 * | 1/2003 | Sutton | 150/105 |
| 2003/0062232 | A1 * | 4/2003 | Godshaw et al. | 190/18 A |
| 2003/0080010 | A1 * | 5/2003 | Ho | 206/373 |
| 2003/0209396 | A1 * | 11/2003 | Bernbaun et al. | 190/18 A |
| 2003/0227148 | A1 * | 12/2003 | Shipman et al. | 280/47.34 |
| 2005/0053315 | A1 * | 3/2005 | Aasen | 383/119 |
| 2005/0167306 | A1 * | 8/2005 | Ho | 206/373 |
| 2005/0189388 | A1 * | 9/2005 | Godshaw et al. | 224/607 |
| 2006/0011502 | A1 * | 1/2006 | Redzisz | 206/373 |
| 2006/0011686 | A1 * | 1/2006 | Latham | 224/579 |
| 2006/0012139 | A1 * | 1/2006 | Guirlinger | 280/35 |
| 2006/0027475 | A1 * | 2/2006 | Gleason et al. | 206/373 |
| 2006/0037824 | A1 * | 2/2006 | Park et al. | 190/110 |
| 2006/0070901 | A1 * | 4/2006 | Adams et al. | 206/373 |
| 2006/0108368 | A1 * | 5/2006 | Dube et al. | 220/552 |
| 2006/0124488 | A1 * | 6/2006 | Redzisz | 206/373 |
| 2006/0201979 | A1 * | 9/2006 | Achilles | 224/411 |
| 2007/0025647 | A1 * | 2/2007 | Hamlin | 383/14 |
| 2007/0062839 | A1 * | 3/2007 | Patterson | 206/523 |
| 2007/0241113 | A1 * | 10/2007 | Williams | 220/500 |
| 2007/0272719 | A1 * | 11/2007 | Laughton | 224/629 |
| 2008/0067095 | A1 * | 3/2008 | Mueller | 206/373 |
| 2008/0128428 | A1 * | 6/2008 | Beckerman | 220/532 |
| 2008/0169739 | A1 * | 7/2008 | Goldenberg | 312/244 |
| 2008/0179370 | A1 * | 7/2008 | Williams | 224/682 |
| 2008/0202962 | A1 * | 8/2008 | Brouard | 206/373 |
| 2008/0230416 | A1 * | 9/2008 | Brouard | 206/372 |
| 2008/0240624 | A1 * | 10/2008 | Godshaw et al. | 383/40 |
| 2009/0145789 | A1 * | 6/2009 | Panosian et al. | 206/373 |
| 2009/0211934 | A1 * | 8/2009 | McKenzie | 206/373 |
| 2009/0294237 | A1 * | 12/2009 | Sisitsky | 190/103 |
| 2010/0108452 | A1 * | 5/2010 | Williams et al. | 190/18 A |
| 2011/0062034 | A1 * | 3/2011 | Schmidt et al. | 206/1.5 |
| 2011/0114688 | A1 * | 5/2011 | Peng et al. | 224/600 |
| 2011/0268374 | A1 * | 11/2011 | Hotta et al. | 383/104 |
| 2012/0125871 | A1 * | 5/2012 | Zirkle | 211/70.6 |
| 2012/0216928 | A1 * | 8/2012 | Groover | 150/110 |
| 2012/0228171 | A1 * | 9/2012 | Kinskey | 206/349 |
| 2013/0001118 | A1 * | 1/2013 | Kinskey et al. | 206/372 |
| 2013/0119850 | A1 * | 5/2013 | Breyburg | 312/408 |
| 2013/0186794 | A1 * | 7/2013 | Kinskey et al. | 206/372 |
| 2013/0199952 | A1 * | 8/2013 | Kinskey et al. | 206/372 |
| 2013/0248063 | A1 * | 9/2013 | Groover | 150/113 |
| 2014/0123478 | A1 * | 5/2014 | Gylander et al. | 29/700 |
| 2014/0131412 | A1 * | 5/2014 | Canton | 224/640 |
| 2014/0166516 | A1 * | 6/2014 | Martinez et al. | 206/372 |

* cited by examiner

TOOL STORAGE AND TRANSPORT SYSTEM

FIELD OF THE INVENTION

The present invention relates generally to the field of tools, and more particularly to a system to organize, store and transport tools.

BACKGROUND

Various tool holders are known to be useful for workers needing to organize and store or carry a group of tools or transport tools to and from a work site for a specific job. Workers often own several tool bags containing tools specific to a particular type of project, e.g., plumbing, electrical work, carpentry, masonry, etc. The need for multiple tool bags can be expensive. In conventional tool holders and bags, tools may be scattered haphazardly in a compartment or loose tools will be scattered during transport so that it may be difficult to quickly locate a specific tool at the work site. While conventional tool holders and others of the prior art are useful in some instances, there are still numerous deficiencies and the potential for more useful tool systems and features.

SUMMARY OF THE INVENTION

A tool storage and transport system including a tool bag body and a tool organizer slidably attachable to the tool bag body is described herein. The tool bag body can be formed from a base, a first exterior wall perpendicular to the base, and a second exterior wall perpendicular to the base and opposite the first exterior wall. The tool organizer can include an organizer tray having a bottom wall, a plurality of sidewalls generally perpendicular to the bottom wall, a first end, and a second end opposite the first end. The first end of the tool organizer can slidably engage with the first exterior wall. The second end of the tool organizer can also slidably engage with the second exterior wall of the tool bag body.

The first exterior wall can include at least one projection and the first end of the tool organizer can include one or more tracks. The at least one projection can engage with the tracks when slidably attached to the tool bag body. The one or more tracks can also be formed by at least one vertical groove on the first end of the tool organizer corresponding to a shape of the projection.

In some embodiments, the projection can include a generally T-shaped cross section with a trunk side coupled to the exterior wall and a distal side including a first vertical lip and a second vertical lip spaced apart from the first vertical lip. The one or more tracks on the tool organizer can include a first track and a second track. The first vertical lip can be slidably engageable with the first track, and the second vertical lip can be slidably engageable with the second track.

In some embodiments, the projection can include a generally trapezoidal cross section with a minor side coupled to the exterior wall and a major side including a first vertical lip and a second vertical lip spaced apart from the first vertical lip. The one or more tracks on the tool organizer can include a first track and a second track. The first vertical lip can be slidably engageable with the first track, and the second vertical lip can be slidably engageable with the second track.

The tool bag body can also include a modular securing mount on the first exterior wall. The modular securing mount can include a back side and a front side. The back side can couple to the first exterior wall. The front side can include a fitted recess that can engage with the first end of the tool organizer when slidably attached to the tool bag body.

The modular securing mount can also removably attach to the first exterior wall or removably attach to the first end of the tool organizer. The modular securing mount can also include an adjustable fastener. The adjustable fastener can be moveable between a first attachment position and a second attachment position. In the first attachment position, the adjustable fastener can removably attach to the first exterior wall. In the second attachment position, the slidable fastener can removably attach to the first end of the tool organizer. The modular securing mount can include at least one tool receptacle.

The organizer tray can include a plurality of subcompartments. The organizer tray can also include at least one removable divider wall and first and second opposing walls. The at least one removable divider wall can include a first flared edge and a second flared edge opposite the first flared edge. The first and second opposing walls can be selected from the group consisting of the plurality of sidewalls and one or more interior walls. The first opposing wall can include a first facing track for slidably engaging with the first flared edge. The second opposing wall can include a second facing track for slidably engaging with the second flared edge. A top edge of the at least one removable divider wall can include a flared stabilizing portion. The bottom wall of the organizer tray can include at least one pair of alignment members for receiving at least a portion of a bottom edge of the at least one removable divider wall between the pair of alignment members.

The organizer tray can also include additional tool receptacles selected from the group consisting of sleeves, pockets, prongs, and clips. The tool storage and transport system can also include at least one auxiliary tool receptacle separate from the tool organizer and slidably attachable to at least one of the first and second exterior walls of the tool bag body. At least one of the first and second exterior walls can include a plurality of tracks or projections and the at least one auxiliary tool receptacle can engage with at least one of the tracks or projections when slidably attached.

A tool storage and transport system including a tool bag body, a plurality of tool organizers and at least one docking mount is also described herein. The tool bag body can be formed from a base and a plurality of exterior walls perpendicular to the base. Each of the tool organizers can slidably attach to at least one of the plurality of exterior walls. At least one of the tool organizers can include an organizer tray having a bottom wall, a plurality of sidewalls generally perpendicular to the bottom wall, a first end, and a second end opposite the first end. The first end can slidably engage with at least one of the plurality of exterior walls. The at least one docking mount can store at least a portion of the plurality of tool organizers at a location separated from the tool bag body. The at least one docking mount can be adapted for attachment to a surface separate from the tool bag body.

The plurality of exterior walls can include a plurality of securing mounts, and the at least one tool organizer can slidably engage with at least one of the securing mounts. The at least one docking mount can include a plurality of docking mounts, and at least one of the first and second ends of the tool organizer can slidably engage with at least one of the docking mounts.

A method of storing and transporting tools is described herein. The method includes: providing a tool bag body, providing at least one tool organizer including an organizer tray, and slidably attaching the at least one tool organizer into the tool bag body. The tool bag body can be formed from a base and a plurality of exterior walls perpendicular to the base, and the plurality of exterior walls can include at least one securing mount. The organizer tray can have a bottom wall, a plurality of sidewalls generally perpendicular to the bottom wall, a first end and a second end opposite the first end. The first end can slidably engage with at least one of the tool bag securing mounts and at least one docking mount. Slidably attaching the at least one tool organizer into the tool bag body can include the first end slidably engaging with the at least one securing mount.

The method can also include providing at least one docking mount separate from the tool bag body; and storing the at least one tool organizer at a location separated from the tool bag body. The first end of the at least one tool organizer can slidably engage with the docking mount.

These and other features, objects and advantages of the present invention will become more apparent to one skilled in the art from the following description and claims when read in light of the accompanying drawings.

DETAILED DESCRIPTION

Figure 1:
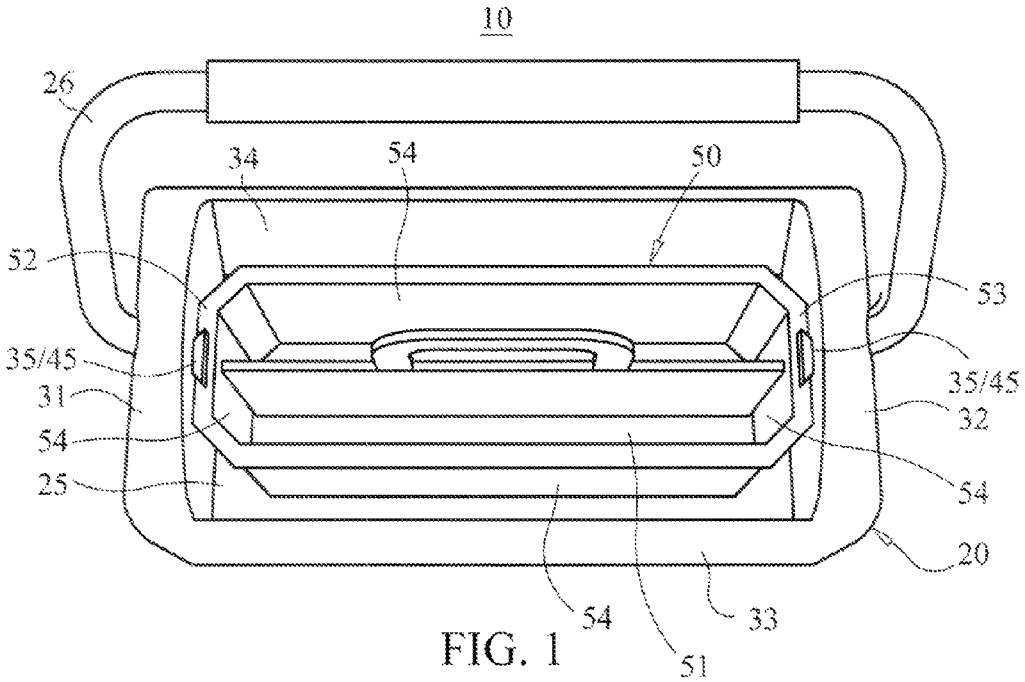
FIG. 1 is a perspective view of a tool storage and transport system described herein.

A tool storage and transport system 10 is described herein. As shown in FIGS. 1-15, the system 10 can include a tool bag body 20 and at least one tool organizer 50 slidably attachable to the tool bag body 20. As shown in FIG. 1, the tool bag body 20 can be formed from a base 25 and a plurality of exterior walls 31, 32, 33, 34 perpendicular to the base 25. The plurality of exterior walls 31, 32, 33, 34 can include a first exterior wall 31 and a second exterior wall 32 opposite the first exterior wall 31. The plurality of exterior walls 31, 32, 33, 34 can also include third and fourth exterior walls 33, 34 opposite one another. The tool bag body 20 can also include handles, straps, and attachment members for handles or straps for carrying the tool bag body 20.

In one arrangement, the tool bag body 20 can include a tool bag handle 26 that is moveable between a carrying position and a resting position where the tool bag handle 26 does not interfere with insertion/removal of or other access to the tool organizer 50. As shown in FIG. 1, the tool bag handle 26 can include a generally C-shaped handle. The handle 26 can be rotatably attached to opposing exterior walls e.g. 31/32, with the ends of the handle 26 inserted through the exterior walls 31, 32 towards an interior of the tool bag body 20. The handle 26 can rotate between the carrying position where the handle 26 can be substantially upright or otherwise positioned above the interior of the tool bag body 20 and the resting position where the handle 26 can be moved to at least one side of the tool bag body 20.

Figure 3:
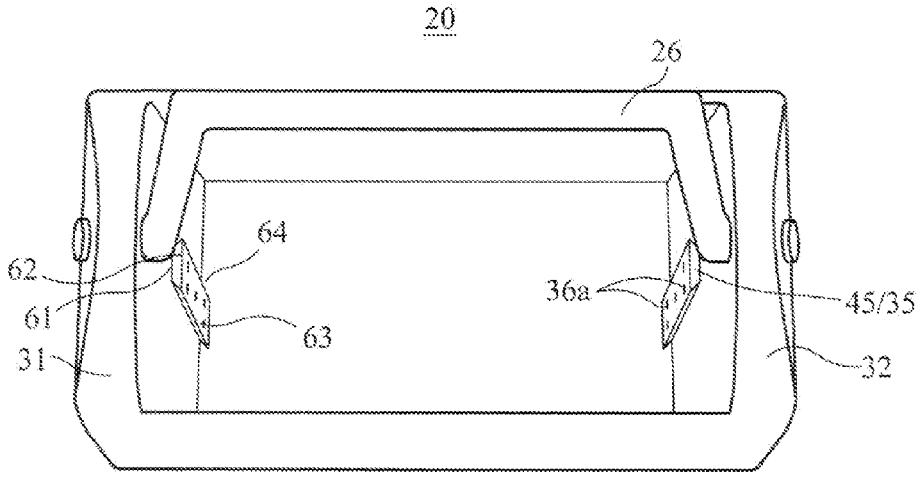
FIG. 3 is a perspective view of a tool bag body described herein.

In another arrangement as shown in FIG. 3, the tool bag handle 26 can include a partial trapezoid shaped handle (comprising one base portion and two leg portions of a trapezoid). The handle 26 can be rotatably attached to opposing exterior walls e.g. 31/32. The ends of the handle 26 can extend outward from the leg portions, with the ends inserted through the exterior walls 31, 32 towards an exterior of the tool bag body 20. The handle 26 can rotate between the carrying position and the resting position. In the resting position, the base portion of the handle 26 can be generally aligned with the exterior walls 33 or 34.

Figure 4:
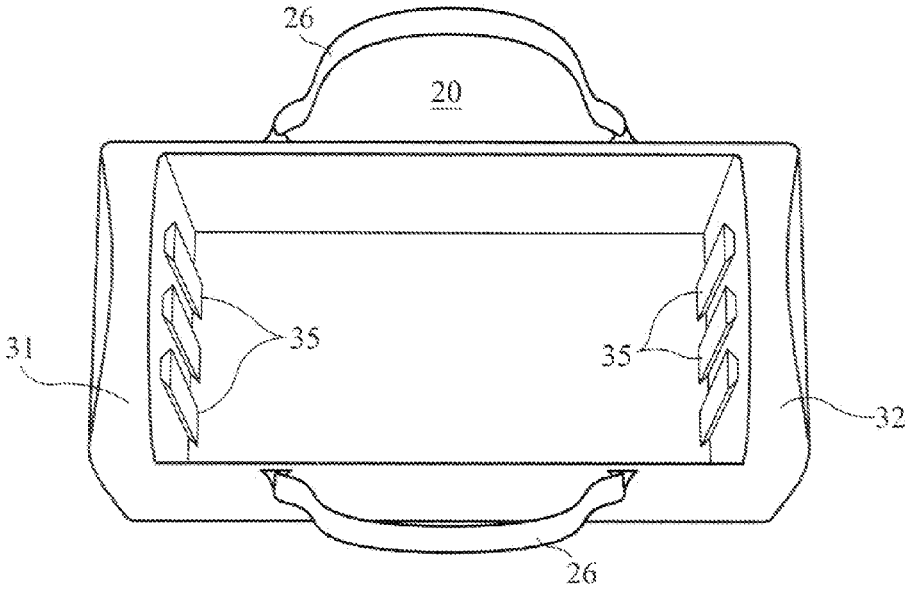
FIG. 4 is a perspective view of a tool bag body described herein.

In another arrangement, the tool bag body 20 can include two tool bag handles 26, with a handle 26 on each of opposing exterior walls, e.g. 33/34, as shown in FIG. 4. The handles 26 can be fixed or moveable between a carrying position where the two handles 26 can be brought together such that a user can grip both handles in one hand and a resting position where the tool bag handles 26 do not interfere with insertion/removal of or other access to the tool organizer 50.

Figure 5:
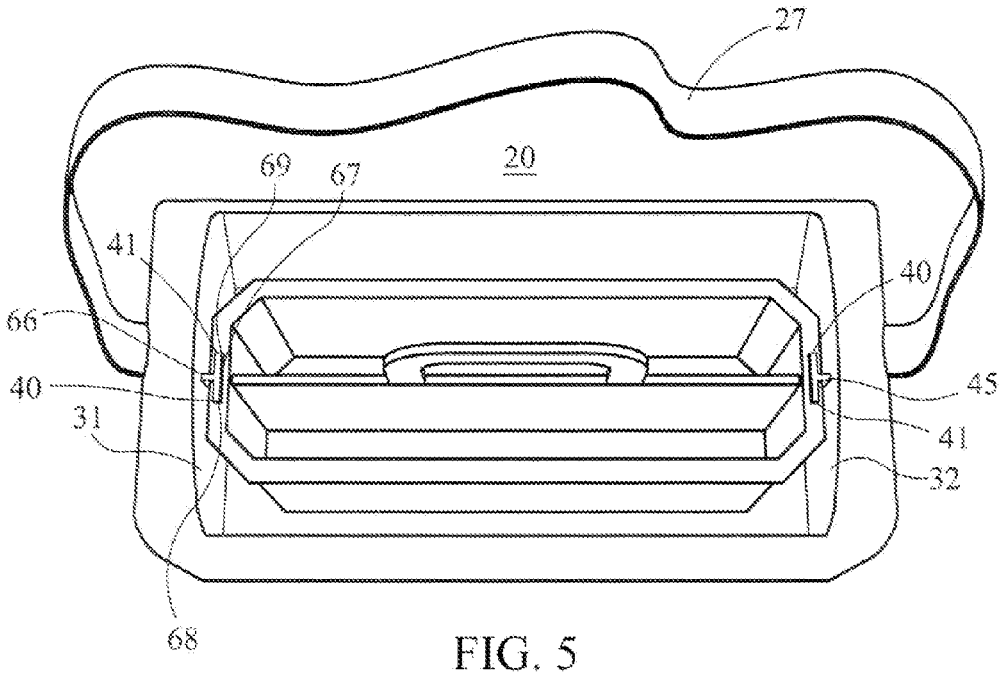
FIG. 5 is a perspective view of a tool storage and transport system described herein.

In another arrangement, the tool bag body 20 can include a carrying strap 27 as shown in FIG. 5 or attachment members for a carrying strap. The carrying strap can also be moveable between a carrying position and a resting position.

The tool organizer 50 can include at least one tool receptacle 55. As used herein, the term "tool receptacle" refers to a receptacle configured to receive and store a tool. Tool receptacles 55 can include without limitation sleeves, pockets, prongs, clips, compartments, subcompartments, and trays. The tool receptacle 55 can be the tool organizer 50 or can be attached to the tool organizer 50.

As shown in FIGS. 1, 2, 5-7, 10, 11C and 12-15, the tool organizer 50 can form an organizer tray 55 having a bottom wall 51, a plurality of sidewalls 54 generally perpendicular to the bottom wall 51, a first end 52, and a second end 53 opposite the first end 52. As used herein, "perpendicular" includes 90 degrees and also minor deviations therefrom such as 75 degrees, 95 degrees, 100 degrees, and 120 degrees.

Figure 2:
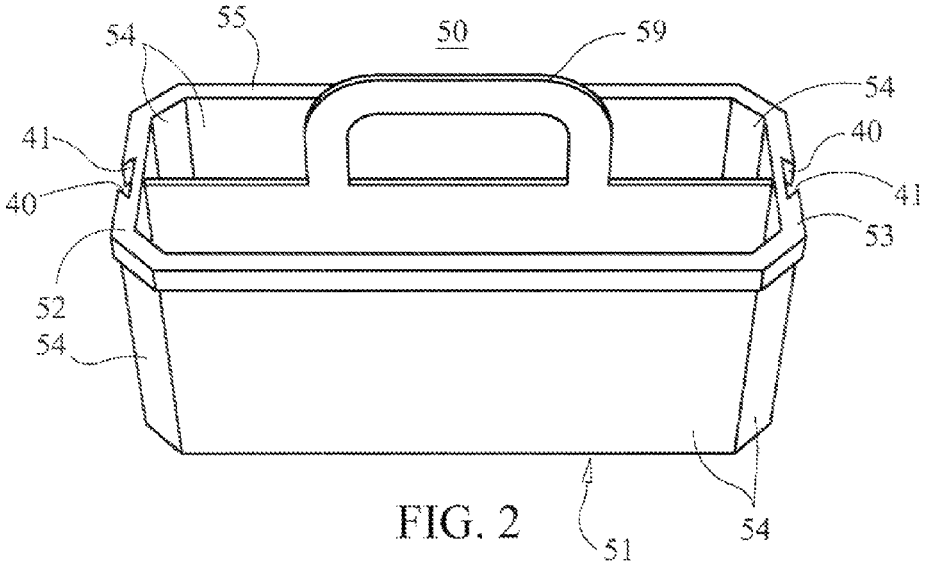
FIG. 2 is a perspective view of a tool organizer described herein.

The plurality of sidewalls 54 can include any combination of linear and curved sidewalls 54. For example, the plurality of sidewalls 54 can include four linear sidewalls forming a square or rectangular tray, the plurality of sidewalls 54 can form a continuous curved wall, or the plurality sidewalls 54 can include any number of sidewalls 54 to form other tray shapes. As shown in FIGS. 1 and 2, the plurality of sidewalls 54 can include eight sidewalls forming a regular octagonal or an extended octagonal tray.

The walls of tool organizer 50 can be collapsible or self-supporting. The tool organizer 50 can be formed from materials including plastics, wood, metals, polymers, fabrics, and combinations thereof. The organizer tray 55 can be formed as a unitary piece, e.g., when formed by injection molding, or can be formed as multiple attached pieces. The tool organizer 50 can be carried separately from the tool bag body 20. As shown in FIG. 2, the tool organizer 50 can stand independently with the bottom wall 51 resting on the ground.

Figure 13:
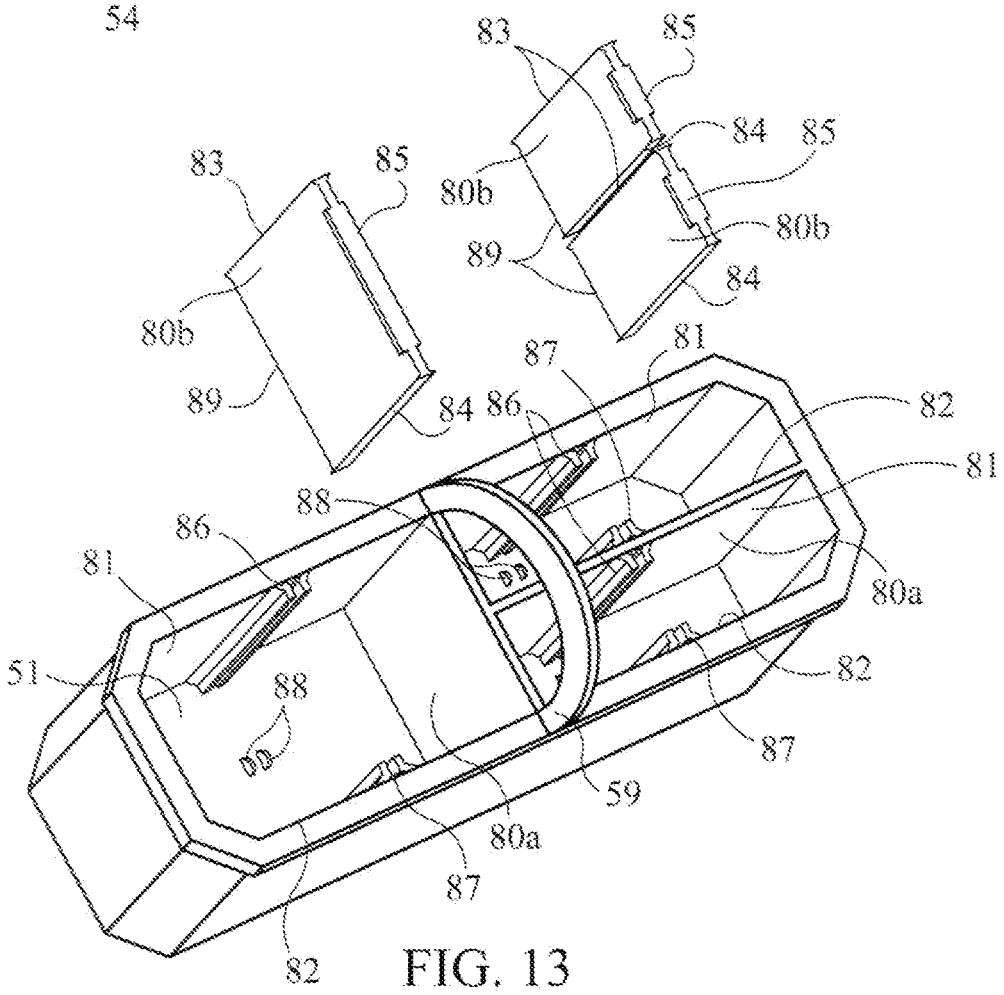
FIG. 13 is an exploded view of the tool organizer of FIG. 12.
Figure 14:
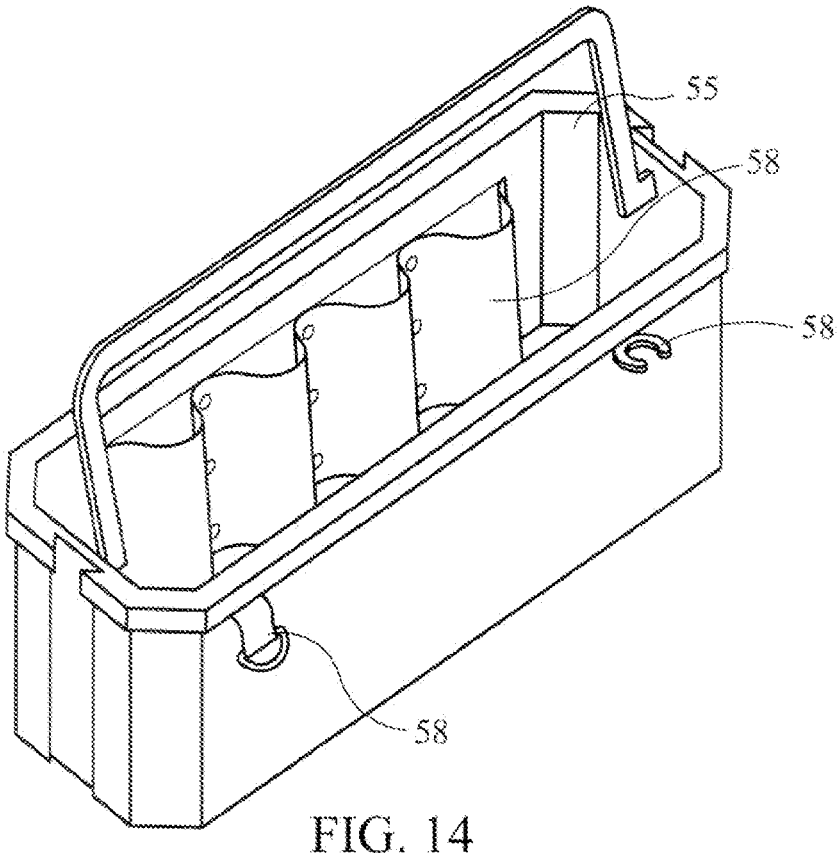
FIG. 14 is a perspective view of a tool organizer described herein.

The first end 52 of the tool organizer 50 can slidably engage with the first exterior wall 31 of the tool bag body 20. The slidable engagement can include direct attachment to the first exterior wall 31 or engagement with structures coupled to the first exterior wall 31. When attached to the tool bag body 20, the tool organizer 50 can extend to the opposing exterior wall 32, only a portion of the length of the tool bag body 20, or to one or more adjacent exterior walls 33, 34. When extending to the opposing/second exterior wall 32, the second end 53 of the tool organizer can also slidably engage with the second exterior wall 32, as shown in FIGS. 1 and 5-7. The first and second exterior walls 31, 32 can be end walls, as shown in FIG. 1, or sidewalls, as shown in FIG. 13.

In order to facilitate the slidable attachment of the tool organizer 50 to the tool bag body 20, the tool bag body 20 can also include at least one securing mount 35 on any of the exterior walls 31, 32, 33, 34 for slidably engaging with a corresponding structure on the tool organizer 50. As shown in FIG. 4, the tool bag body 20 can also include a plurality of securing mounts 35 and the plurality of securing mounts 35 can also be included on the same exterior wall 31, 32. The at least one securing mount 35 can be coupled to an interior surface of the exterior walls 31, 32, 33, 34.

The securing mount 35/47 can be permanently or removably attached to the exterior walls 31, 32, 33, 34 with one or more fasteners 36 including, but not limited to, rivets, screws, nails, staples, hooks, dips, stitching, hook and loop fasteners, and adhesives. For example as shown in FIG. 3, the securing mount 35 can be attached to wall 31 with a plurality of rivets 36*a*. As shown in FIG. 8, the securing mount 35147 can also be attached to wall 31 with hook and loop fasteners 36*b*, 36*c*. As shown in FIG. 10A, the securing mount 35 can also be attached to wall 31 with a fastener 37 having a leg 39A extending from a back side of the securing mount 35. The leg 39A can engage with a bracket 42 on or a recess in the wall 31.

The securing mount can extend across the entire length or width of the tool bag storage compartment. In such devices, the securing mount 35 can be held in place against an exterior wall 31, 32 by compression and/or friction from supporting walls on either side, such as exterior walls 33, 34. For example, in FIG. 7 instead of fasteners 36*b*, 36*c*, the securing mount 35 can be held flush against end walls 31, 32 by compression and/or friction from opposing sidewalls 33,34. The securing mount 35 can also be integral with a wall 31, 32, 33, 34 such as by injection molding.

In some arrangements, such as FIGS. 3-6, the securing mount 35 can include a projection 45, or one or more tracks 40, 41, or both. The first end 52 of the tool organizer 50 can engage with the track(s) 40, 41 and/or projection(s) 45 on one or more of the exterior walls 31, 32, 33, 34 when slidably attached to the tool bag body 20. The first end 52 of the tool organizer 50 can include a projection 45, a track 40, or a plurality of projections 45 or tracks 40, 41 for engagement with a corresponding track 40 or projection 45 on the exterior walls 31, 32, 33, 34.

As shown in FIGS. 1 and 3-5, the first exterior wall 31 can include at least one projection 45 and the first end 52 of the tool organizer 50 can include one or more tracks 40, 41. The one or more tracks 40, 41 can be formed by at least one vertical groove on the first end 52 of the tool organizer 50; and the vertical groove can correspond to a shape of the projection 45. The projection 45 can slidably engage with the track(s) 40, 41, but cannot be removed by a horizontal force.

The projection 45 can include a generally trapezoidal cross section as shown in FIGS. 1, 3 and 4. As shown in FIG. 3, a minor side 61 of the projection 45 can include a longitudinal surface formed by the edge that runs between two adjacent obtuse angle vertices of the trapezoidal cross section. A major side 62 of the projection 45 can include another longitudinal surface formed by the edge that runs between two adjacent acute angle vertices of the trapezoidal cross section. The minor side 61 can be coupled to the exterior wall 31 with the longitudinal surfaces oriented in the vertical direction and the major side 62 facing into the interior of the tool bag body 20. The major side 62 of the projection 45 can include a first vertical lip 63 and a second vertical lip 64 spaced apart from the first vertical lip 63. The first and second vertical lips 62, 63 extend longitudinally along the length of the projection 45 and can include the obtuse angle vertices and at least a portion of the adjacent edges of the trapezoidal cross section. The one or more tracks 40, 41 can include a first track 40 and a second track 41 as shown in FIG. 2. The first vertical lip 63 can slidably engage with the first track 40 and the second vertical lip 64 can slidably engage with the second track 41.

The projection 45 can also include a generally T-shaped cross section as shown in FIG. 5. A trunk side 66 of the projection 45 can include a longitudinal surface formed by the base of the "T" in the T-shaped cross section. A distal side 67 of the projection 45 can include another longitudinal surface formed by the top of the "T" in the T-shaped cross section. The trunk side 66 can be coupled to the exterior wall 31. The distal side 67 of the projection 45 can include a first vertical lip 68 and a second vertical lip 69 spaced apart from the first vertical lip 68. The one or more tracks 40, 41 can include a first track 40 and a second track 41. The first vertical lip 68 can slidably engage with the first track 40 and the second vertical lip 69 can slidably engage with the second track 41.

Figure 6:
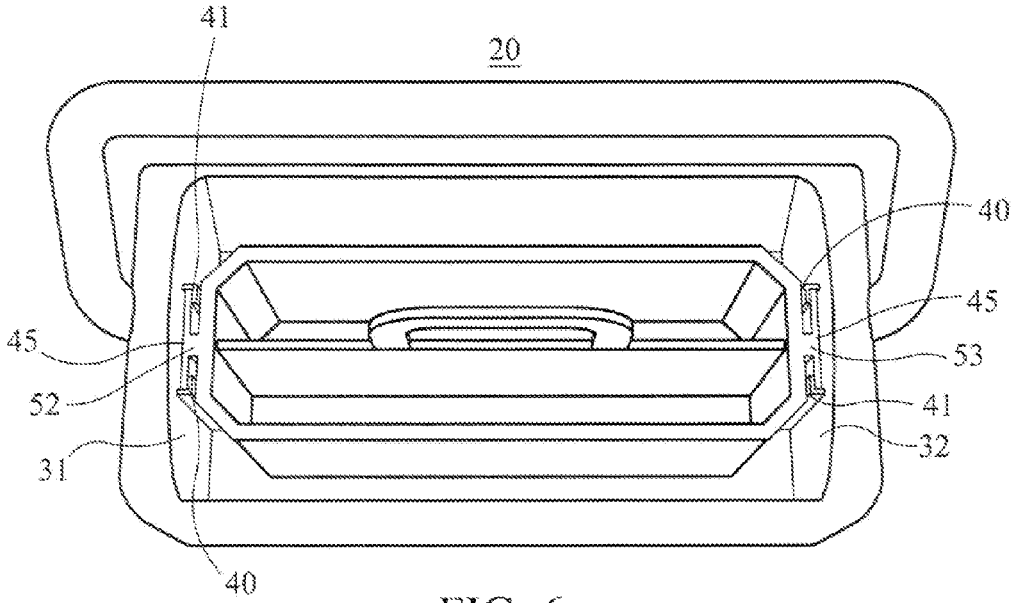
FIG. 6 is a perspective view of a tool storage and transport system described herein.

In another arrangement as shown in FIG. 6, the first end 52 of the tool organizer 50 can include at least one projection 45 and the first exterior wall 31 can include one or more tracks 40, 41. The one or more tracks 40, 41 can include a pair of inwardly facing tracks 40, 41 and the corresponding projection 45 can slidably engage with the pair of tracks 40, 41. For example, two tracks 40, 41 can form a pair of substantially L-shaped tracks positioned with the receiving portions of each track 40, 41 facing towards each other. The first end 52 of the tool organizer 50 can include a corresponding T-shaped projection 45 adapted to slide between the pair of L-shaped tracks 40, 41. The pair of L-shaped tracks can be separate tracks or part of a single, generally C-shaped track.

In other arrangements, the securing mount 35 can include a modular securing mount 47 as shown in FIGS. 7-10. The walls of modular securing mount 47 can be collapsible or self-supporting. The modular securing mount 47 can be inserted in the tool bag body 20 against exterior wall 31. A back side of the modular securing mount 47 can be coupled to the exterior wall 31. A front side of the modular securing mount 47 can form a fitted recess 48 that corresponds to a shape of the first end 52 of the tool organizer 50, such that the fitted recess closely fits against and slidably engages with the first end 52 of the tool organizer 50. From a top view, the fitted recess 48 can include a generally concave shape.

Figure 7:
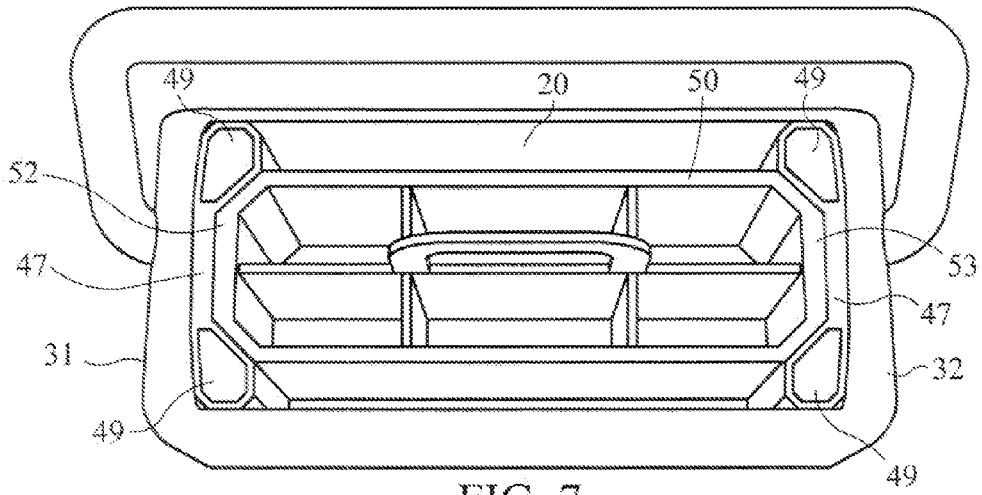
FIG. 7 is a perspective view of a tool storage and transport system described herein.

The tool bag body 20 can also include a plurality of modular securing mounts 47. The plurality of modular securing mounts 47 can be coupled to any of the exterior walls 31, 32, 33, 34. For example, as shown in FIG. 7, modular securing mounts 47 can be coupled to opposing end wads 31, 32 and secured in place by (i) compression from the opposing sidewalls 33, 34, (ii) a removable fastener (e.g., hook-and-loop material), or (iii) both. The first end 52 of the tool organizer 50 can slidably engage with one modular securing mount 47 and the second end 53 of the tool organizer can slidably engage with a second modular securing mount 47 secured to the opposing end wall 32. The tool organizer 50 can be nested between and against the modular securing mounts 47. For example, the length of the tool organizer 50 can be substantially the same as the distance between opposing modular securing mounts 47. The tool organizer 50 can be removably and slidably inserted between the modular securing mounts 47 such that the fitted recess 48 on each of the modular securing mounts 47 receives an end 52, 53 of the tool organizer 50.

Figure 8A:
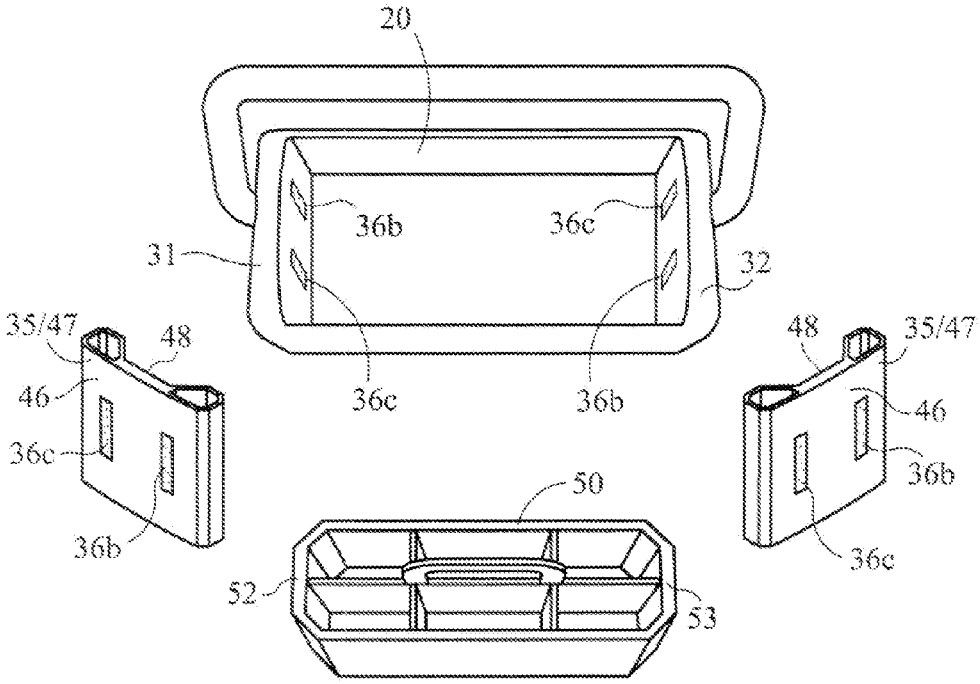
FIG. 8A is an exploded view of the tool storage and transport system of FIG. 7.

As shown in FIGS. 7 and 8A, the modular securing mount 47 can include a substantially flat back side 46 that can fit against the exterior wall 31. A front side of the modular securing mount 47 can include at least three linear wads forming a generally concave fitted recess 48. At least the first end 52 of the tool organizer 50 can include a corresponding convex end shape such that the convex end shape of the first end 52 is fitted to the concave fitted recess 48 of the securing mount 47.

For example, when supported against the exterior wall 31, 32, the concave fitted recess 48 of each modular securing mount 47 can include a middle wall that is substantially parallel to the back side 46 and at least one outer wall extending laterally from each side of the middle wall and angled toward the interior of the tool bag body 20 thereby forming a partial trapezoidal shape. The first end 52 of the tool organizer 50 or both the first and second ends 52, 53 can include at least three linear sidewalls 54 forming a corresponding partial trapezoidal end shape, and the ends of the no organizer 52, 53 and the fitted recess 48 of the securing mounts 47 can fit together as shown in FIG. 7.

The corresponding configurations of the tool organizer end 52, 53 the fitted recess 48 at each end 52, 53 prevents lateral movement of the tool organizer 50 within the tool bag body 20. When removably inserted between and against the modular securing mounts 47, the tool organizer 50 is securely positioned within the tool bag body 20.

The coupling of the modular securing mount 47 against the exterior wall 31 can be permanent or removable. As described above, various fasteners 36 can be used to attach the modular securing mount 47 to the exterior wall 31, or compression from adjacent walls 33, 34 can hold the modular securing mount 47 against the exterior wall 31, or the modular securing mount 47 can be integral with the exterior wall 31.

Figure 8B:
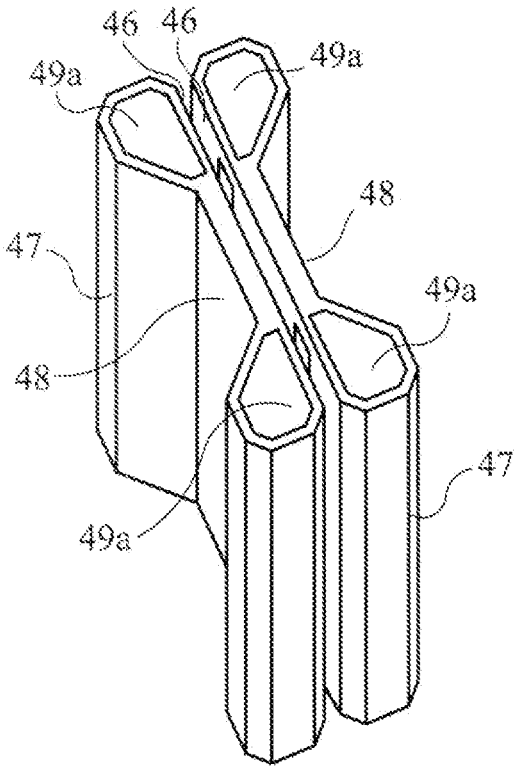
FIG. 8B is a perspective view of the modular securing mounts of FIG. 7.

For removably coupled modular securing mounts 47, each modular securing mount 47 can include alternating fasteners 36*b*, 36*c* such that modular securing mounts 47 can be attached to one another because fastener 36*b* connects to fastener 36*c*. For example, as shown in FIG. 8, hook and loop fasteners can be used as the alternating fasteners 36*b*, 36*c* and the back side 46 of each modular securing mount 47 can include a hook portion 36*b* and *a* loop portion 36*c*. When removed from the exterior walls 31, 32, the back sides 46 of the modular securing mounts 47 can be attached to one another as shown in FIG. 8B, with the hook portion 36*b* on a first modular securing mount 47 connecting to the loop portion 36*c* on a second modular securing mount 47 and the loop portion 36*c* on the first modular securing mount 47 connecting to the hook portion 36*b* on the second modular securing mount 47.

Figure 9:
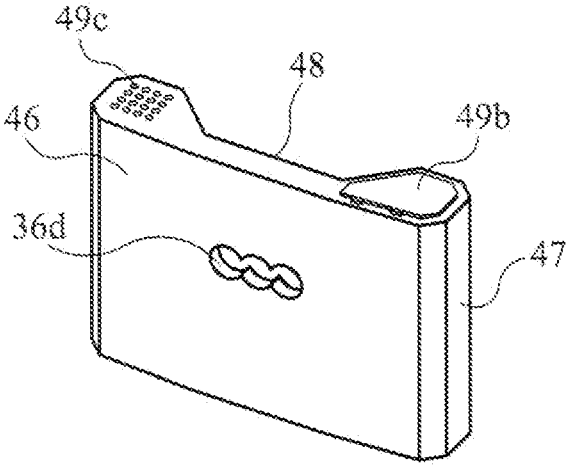
FIG. 9 is a perspective view of a modular securing mount described herein.

As shown in FIG. 9, the modular securing mount 47 can also include one or more apertures on the back side 46 for receiving a fastener 36 to couple the modular securing mount 47 to the exterior wall 31. For example, the modular securing mount 47 can be secured to the exterior wall 31 with screws, rivets, pegs, pins, and similar fasteners received within or through the apertures on the back side 46.

Figure 10:
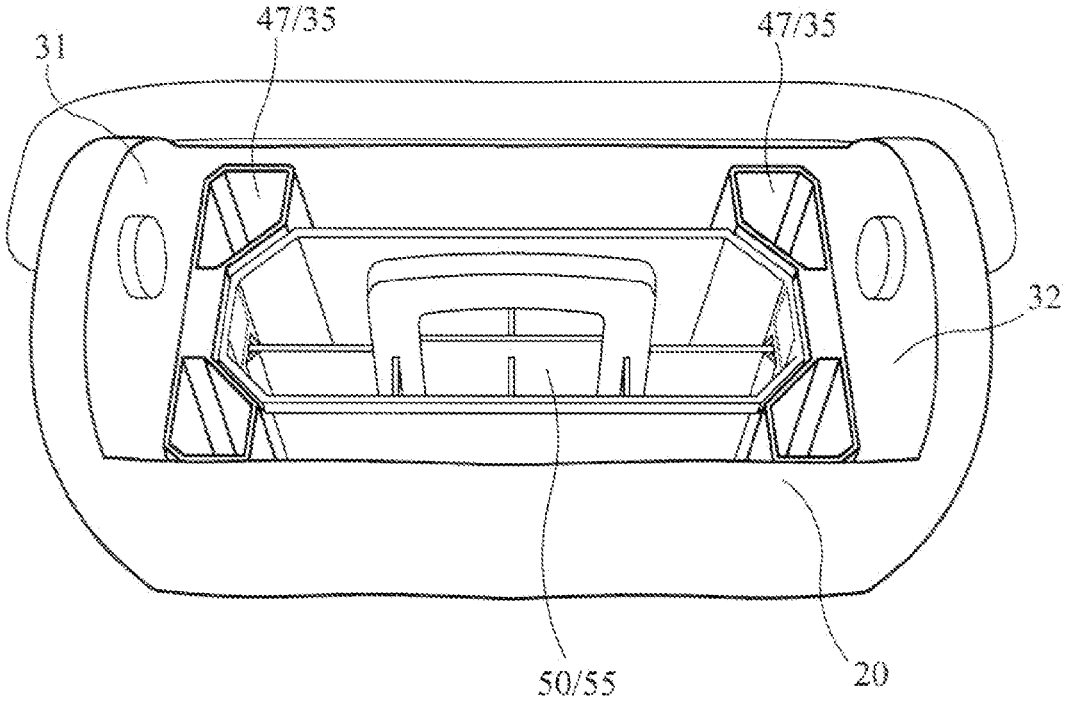
FIG. 10 is a perspective view of a tool storage and transport system described herein.
Figure 11A:
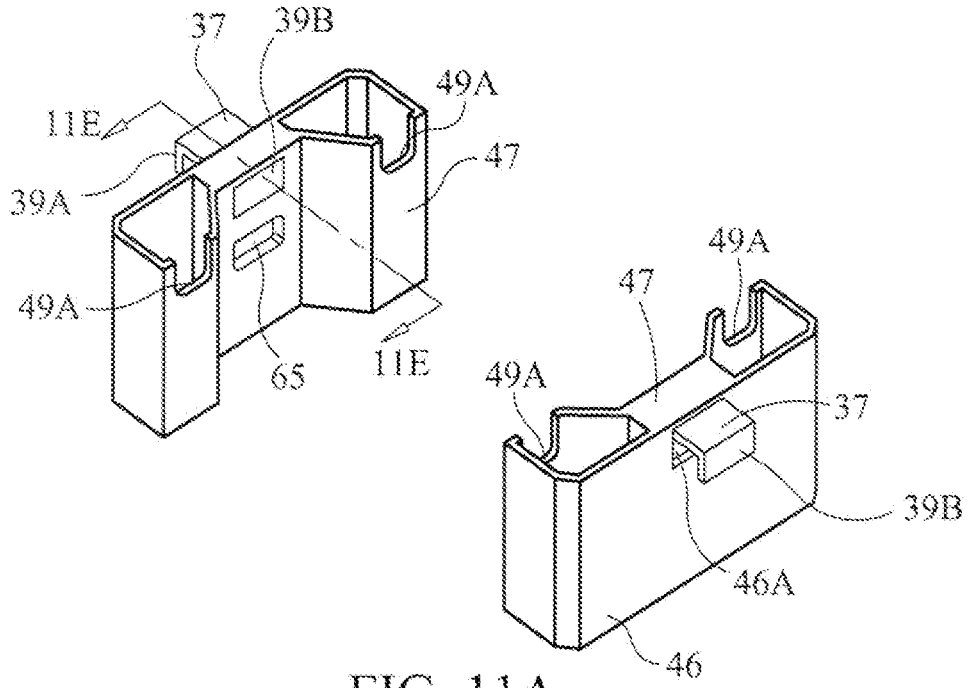
FIG. 11A is a perspective view of the modular securing mounts of FIG. 10 with the adjustable fasteners in a first position.
Figure 11B:
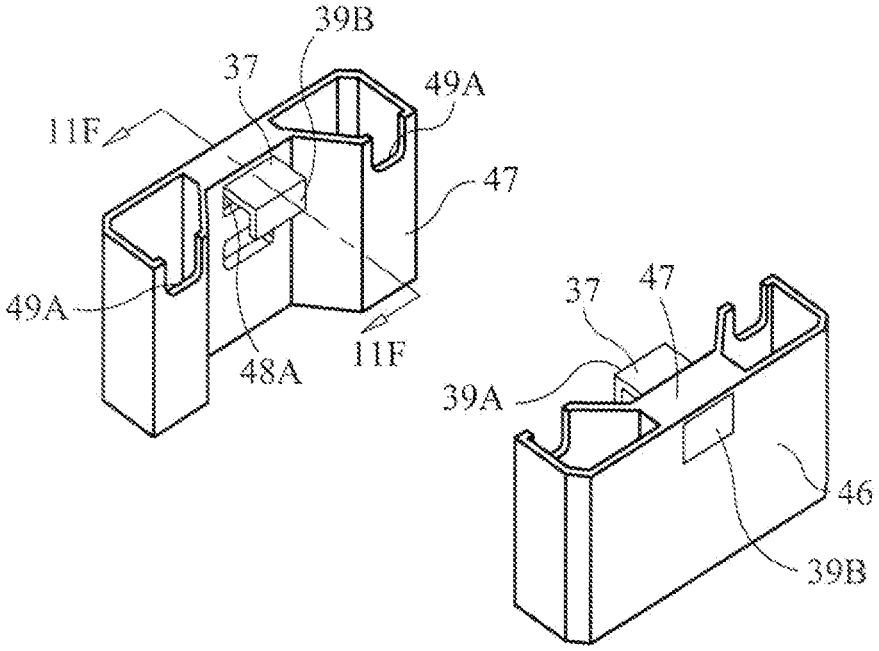
FIG. 11B is a perspective view of the modular securing mounts of FIG. 10 with the adjustable fasteners in a second position.
Figure 11C:
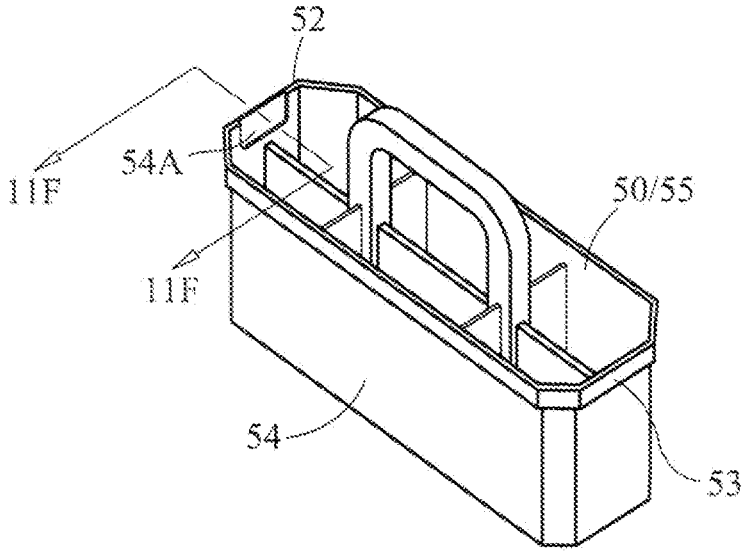
FIG. 11C is a perspective view of the tool organizer of FIG. 10.
Figure 11D:
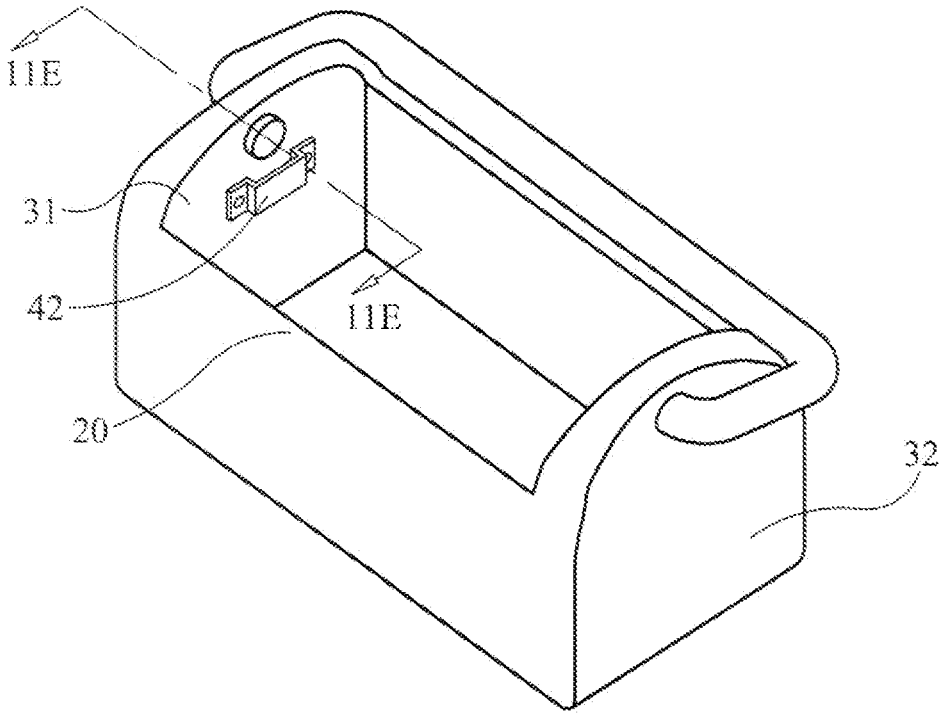
FIG. 11D is a perspective view of the tool bag body of FIG. 10.
Figure 11E:
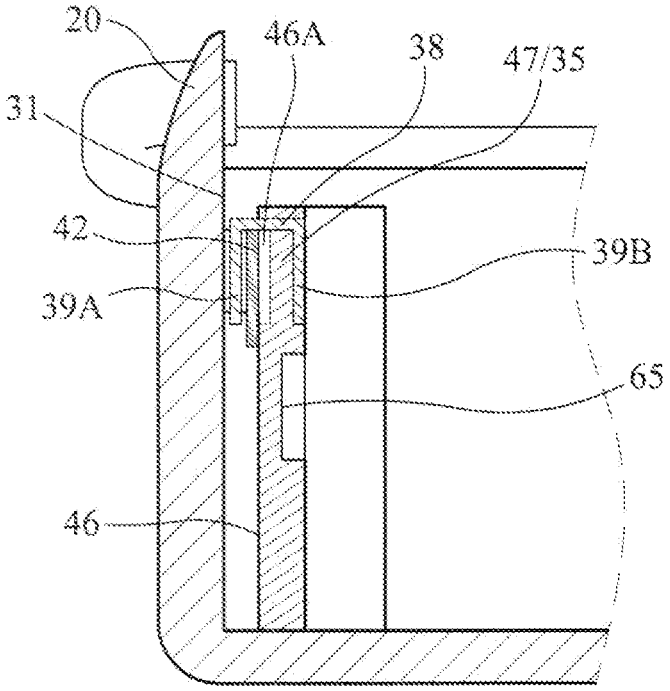
FIG. 11E is a cross-sectional schematic view of one of the securing mounts of FIG. 11A mounted to a bracket of the tool bag body FIG. 11D along cut lines 11E-11E.
Figure 11F:
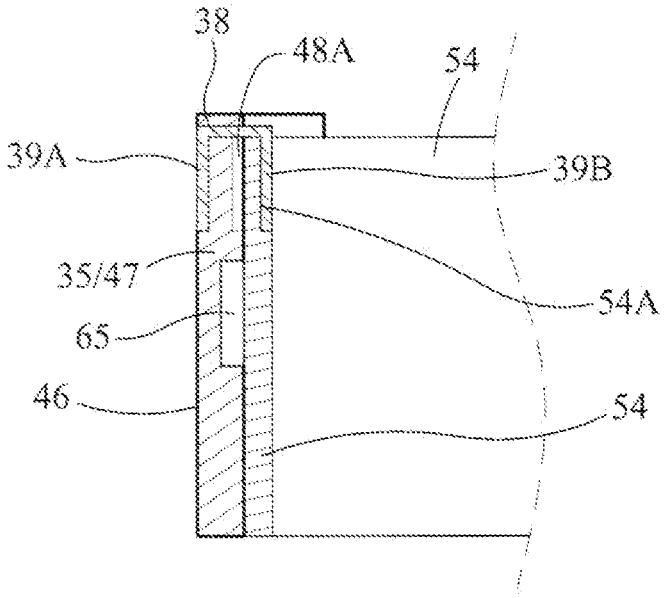
FIG. 11F is a cross-sectional schematic view of one of the securing mounts of FIG. 11B mounted to the tool organizer of FIG. 11C along cut lines 11F-11F.

As shown in FIGS. 10-11F, the modular securing mount 47 can also include a fastener 37 that can attach to either the tool bag body 20 or the tool organizer 50. In one arrangement, the fastener 37 has one or more legs 39, including a first leg 39A that can extend from the back side 46 of the modular securing mount 47 for engagement with a bracket 42 on an inside of an exterior wall 31 or a top edge of an exterior wall 31. The fastener 37 can also include a second leg 39B that can extend from the front side of the modular securing mount 47 for engagement with a top edge of a sidewall 54 of the organizer tray 55.

The fastener 37 can also be an adjustable fastener 37 that is movable between a first attachment position and a second attachment position. For example, the fastener 37 can be slidably coupled to a wall of the modular securing mount 47 and can slide between the first attachment position as shown in FIG. 11A and the second attachment position as shown in FIG. 11B.

The front side of the modular securing mount 47 can also include a recessed portion 48A corresponding to at least a portion of the shape of the second leg 39B. When the adjustable fastener 37 is in the first attachment position, the second leg 39B can engage with the recessed portion 48A and can form a substantially flush surface with the front side. The back side 46 of the modular securing mount 47 can also include a recessed portion 46A corresponding to at least a portion of the shape of the first leg 39A. When the adjustable fastener 37 is in the second attachment position, the first leg 39A can engage with the recessed portion 46A and can form a substantially flush surface with the back side 46 of the modular securing mount 47.

In the first attachment position, the adjustable fastener 37 can be configured for removable attachment to at least one of the exterior walls 31, 32, 33, 34. For example as shown in FIG. 11A, in the first attachment position, the first leg 39A can extend from the back side 46 of the modular securing mount 47. When the modular securing mount 47 is removably attached to the wall 31 as shown in FIG. 11E, the first leg 39A can engage with a bracket 42 or similar securing structure on the wall 31. The adjustable fastener 37 can also be configured for removable attachment to the tool organizer 50 in the first attachment position. For example, the first leg 39A can engage with one or more sidewalls 54 and/or recessed portions 54A of the organizer tray 55.

In the second attachment position, the adjustable fastener 37 can be configured for removable attachment to the tool organizer 50. For example as shown in FIG. 11B, in the second attachment position, the second leg 39B can extend from the front side of the modular securing mount 47. When removably attached to the organizer tray 55 as shown in FIG. 11F, the second leg 39B can engage with a tray sidewall 54. The sidewall 54 can also include a recessed portion 54A corresponding to at least a portion of the shape of the second leg 39B. The recessed portion 54A can be provided on an inner side of a sidewall 54 and, when the modular securing mount 47 is removably attached to the organizer tray 55, the second leg 39B can engage with the recessed portion 54A and can form a substantially flush surface with the inner side of the sidewall 54.

When the modular securing mounts 47 are removably attached to the organizer tray 55 with the fasteners 37, the mounts 47 can be supported by the tray 55 when the tray is carried by a handle. In this manner, the tray/mount combination is self-supporting and can be transported simultaneously with one hand even when removed from the tool bag body 20. In one arrangement, one modular securing mount 47 can be removably attached to the first end 52 of the organizer tray 55, another modular securing mount 47 can be removably attached to the second end 53, and the tray 55 and mounts 27 can be carried by the handle 59 on the tray 55. In another arrangement, at least two modular securing mounts 47 can be removably attached to other sidewalls 54 of the organizer tray 55. The shape of the securing mounts 47 enables the securing mount 47 to be attached to the ends of the organizer tray 55 using either the first leg 39A or the second leg 39B depending on the user's preference.

The adjustable fastener 37 can be slidably engaged with the modular securing mount 47. In one arrangement as shown in FIGS. 11E and 11F, the first and second legs 39A, 39B can be separated by an intermediate portion 38 configured to at least partially slide through a portion of the modular securing mount 47. The first leg 39A can be positioned proximate the back side 46 of the securing mount 47, the second leg 39B can be positioned proximate the front side, and the intermediate portion 38 can pass through the modular securing mount 47. The adjustable fastener 37 can slide between the first attachment position and the second attachment position. The distance between the legs 39A, 39B can be such that the adjustable fastener 37 can only removably attach to one of the tool bag body 20 and the tool organizer 50 at a time.

The modular securing mount 47 can also include one or more grips 65 for facilitating a user's grip on the mount 47 when inserting or removing the modular securing mount 47 from the tool bag body 20. For example, the grip 65 can include an opening in a wall of the modular securing mount 47 as shown in FIG. 11A.

The modular securing mount 47 can also include one or more tool receptacles 49 configured to hold tools, parts, hardware or similar items. For example, tool receptacles 49 can be provided on one or both sides of the fitted recess 48. As shown in FIGS. 7-9, the modular securing mount 47 tool receptacles 49 can include, without limitation, open-top compartments 49*a*, compartments with lids 49*b*, and apertures 49*c* for receiving and supporting tools such as pencils and screwdrivers or parts such as drill bits, etc. The compartment walls for the tool receptacles 49 can include at least a portion of the back side 46 of the securing mount 47 and at least a portion of the two outer walls of the fitted recess 48 of the securing mount 47.

The dimensions of the modular securing mount 47 can vary as needed. A height of the modular securing mount 47 can be less than, substantially the same as, or greater than the height of the exterior wall 31. A length of the modular securing mount 47 can be substantially the same as the first exterior wall, and extend from one adjacent wall 33 to the other adjacent wall 34 or only a portion of the length of the first exterior wall 31.

The organizer tray 55 of the tool organizer 50 can form a main compartment. The organizer tray 55 can also include a plurality of subcompartments. The subcompartments can be formed by interior walls including permanent or removable divider walls, as shown in FIGS. 1, 2, 7, 8, 10, 11C, 12, 13 and 15.

Figure 12:
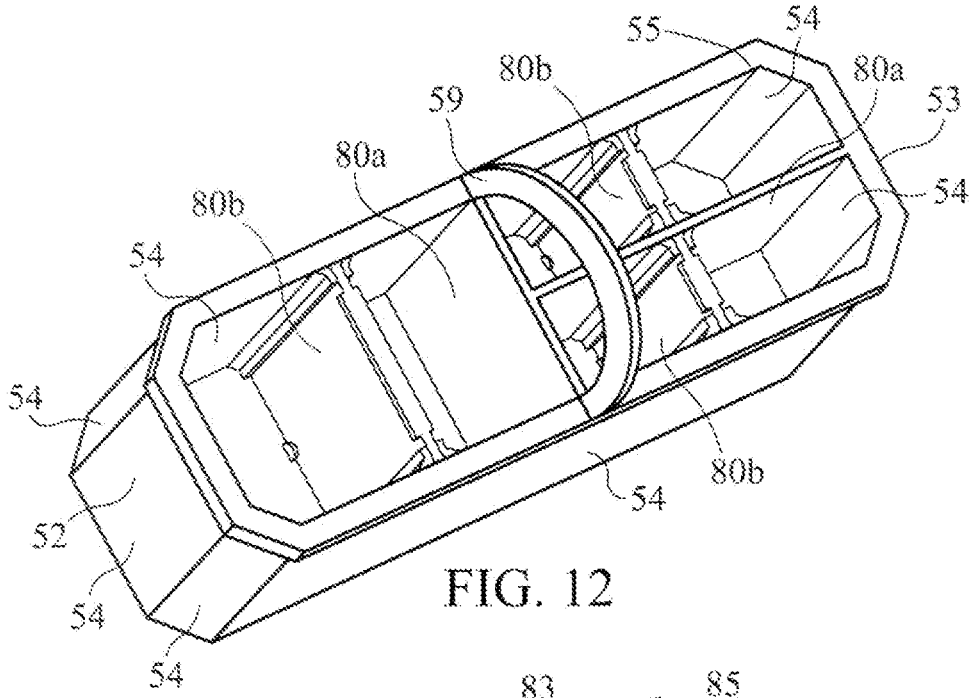
FIG. 12 is a perspective view of a tool organizer described herein.

As shown in FIGS. 12 and 13, the organizer tray 55 can also include at least one removable divider wall 80 that can be removably inserted between two opposing walls 81, 82 within the main compartment. The first and second opposing walls 81, 82 can include any combination of sidewalls 54 or interior walls 80. For example, the opposing walls 81, 82 can include two sidewalls 54. The opposing walls 81, 82 can also include an interior wall 80 and a sidewall 54. The opposing walls 81, 82 can also include two interior walls 80, and the interior walls 80 can be either permanent divider walls 80*a* or removable divider walls 80*b*.

Each removable divider wall 80*b* can also include a first flared edge 83 and a second flared edge 84 opposite the first flared edge 83. A top edge of the removable divider wall 80*b* can also include a flared stabilizing portion 85. The first opposing wall 81 can also include a first track 86 for slidably engaging with the first flared edge 83 of the removable divider wall 80*b*, and the second opposing wall 82 can include a second track 87 for slidably engaging with the second flared edge 84 of the removable divider wall 80*b*. The first and second tracks 86, 87 can be oriented to extend perpendicular to the bottom wall 51 of the organizer tray 50.

The bottom wall 51 can also include at least one pair of alignment members 88. The pair of alignment members 88 can be adapted for receiving at least a portion of a bottom edge 89 of the removable divider wall 80*b* between the pair of alignment members 88. For example, the alignment members 88 can be projections 88 that extend from the bottom wall 51. The projections 88 can be semi-circles, rectangular solids or other shapes capable of stabilizing the bottom edge 89 of the removable divider wall 80*b*. One of the pair of alignment member projections 88 can be positioned on each side of the bottom edge 89 when the removable divider wall 80*b* engages with the first and second tracks 86, 87 and is inserted in the organizer tray 55.

The organizer tray 55 can also include one or more tray handles 59. For example, the tray handle 59 can extend upwardly from a top end of said organizer tray 55. The tray handle 59 can be configured such that the tray handle 59 does not interfere with movement of the tool bag handle 26 between the carrying position and the resting position. For example, a height of the tray handle 59 as measured from the bottom wall 51 of organizer tray 55 can be less than a height of the tool bag handle 26 as measured from the base 25 of the tool bag body 20 when the tool bag handle 26 is in the carrying position.

Figure 15:
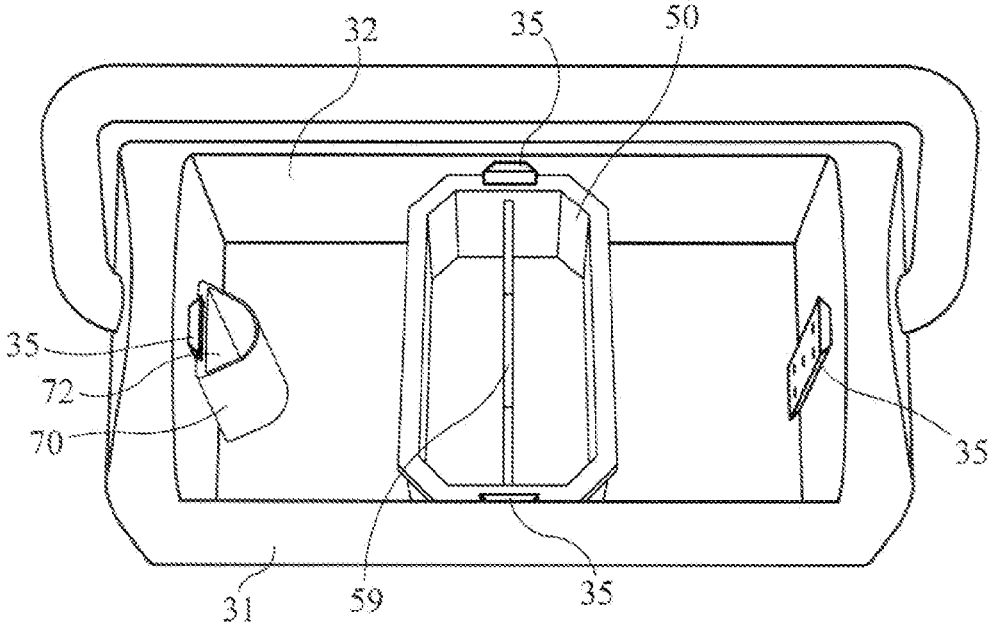
FIG. 15 is a perspective view of a tool storage and transport system with a tool organizer and an auxiliary tool receptacle attached thereto.

As shown in FIG. 15, the organizer tray 55 can also include additional tool receptacles 58 attached to the bottom wall 51, sidewalls 54, or interior walls. The additional tool receptacles 58 can include different types of tool receptacles, including sleeves, pockets, prongs, clips, hooks, loops, bins, and combinations thereof.

Figure 16:
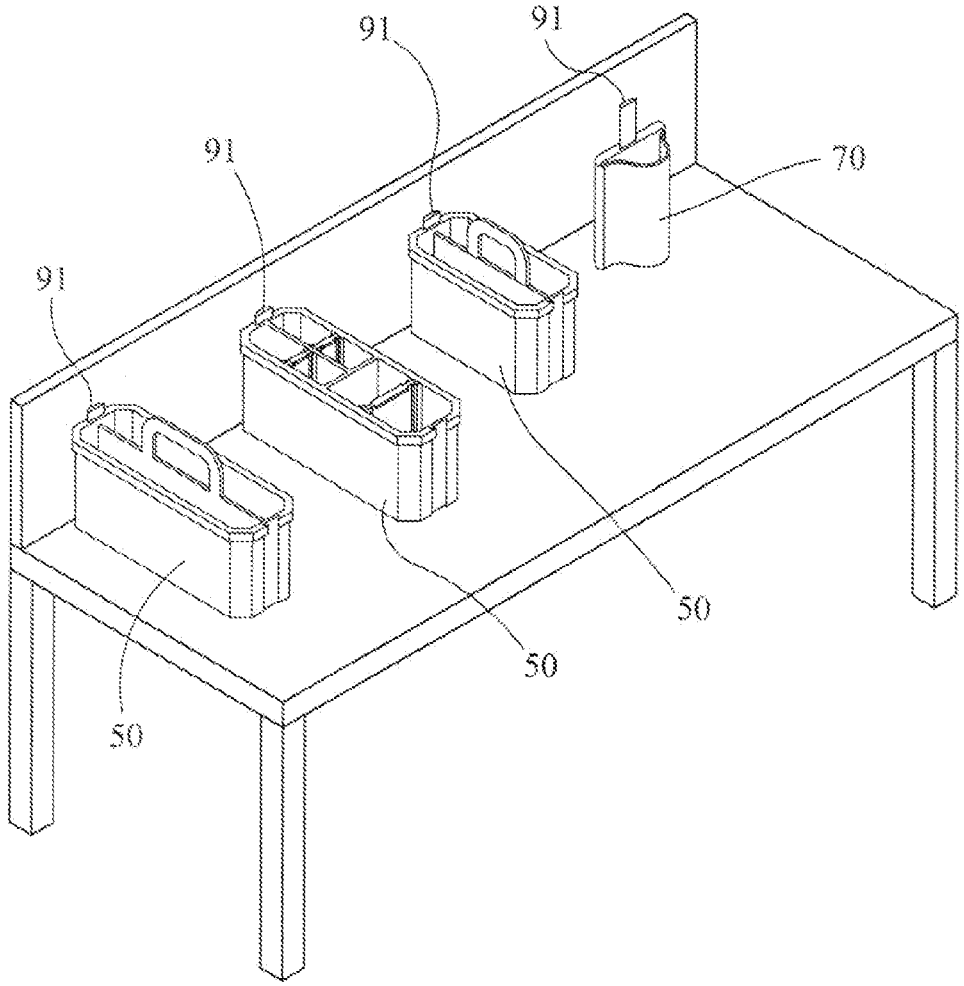
FIG. 16 is a perspective view of the tool storage and transport system described herein, where tool organizers are attached to docking mounts on a workbench.

As shown in FIG. 16, the tool storage and transport system 10 can also include one or more auxiliary tool receptacles 70 slidably attachable to an individual exterior wall 31, 32, 33 or 34. As used herein, "auxiliary tool receptacle" refers to a receptacle configured to receive and store a tool that can be removably attached to only one wall at a time. Auxiliary tool receptacles 70 are adapted to extend generally parallel to the wall to which it is attached. The auxiliary tool receptacle 70 can also include a back wall 72 and, when attached to an exterior wall, the back wall 72 can be substantially parallel to the exterior wall. The auxiliary tool receptacle 70 is configured to store a tool alongside the wall to which it is attached and does not extend perpendicular or diagonally across the length of the tool bag body 20, e.g. from one exterior wall to another exterior wall. For example, the auxiliary tool receptacle 70 can include a sleeve, pocket, other similar tool receptacles, or combinations thereof.

The auxiliary tool receptacle 70 can also slidably engage with at least one of the securing mounts 35 on the exterior walls 31, 32, 33, 34. Thus, the auxiliary tool receptacle 70 can be removably attached to the tool bag body 20 when the tool organizer 50 is removed or can be removably attached to any of the securing mounts 35 that are not slidably engaged with the tool organizer 50.

The tool storage and transport system 10 can also include a plurality of tool organizers 50. The plurality of tool organizers 50 can include the same or different types of organizer trays 55 and other tool receptacles. The plurality of tool organizers 50 can be interchangeably inserted into the tool bag body 20.

As shown in FIG. 15, the tool storage and transport system 10 can also include at least one docking mount 91 for storing at least one tool organizer 50 or auxiliary tool receptacle 70 separate from the tool bag body 20. The docking mount 91 can be adapted for attachment to a surface located remotely from the tool bag body 20, including without limitation a surface on a work bench, a surface on a storage closet or other container, a wall-mountable partition, or a wall. However, the tool storage and transport system 10 and the docking mount 91 need not necessarily include the surface to which the docking mount 91 will be attached.

At least one of the first and second ends 52, 53 of the tool organizers 50 can be slidably attachable to at least one docking mount 91, as well as, at least one securing mount 35 attached to a wall 31, 32, 33, 34 of the tool bag body 20. The docking mount 91 can have a similar or different configuration than the securing mount(s) 35 in the tool bag body 20.

In one arrangement, the docking mounts 91 can include docking projections 91 that are similar or identical to the tool bag projections 45 and the first end 52, second end 53, or both of each tool organizer 50 can slidably engage with either one of the docking projections 91 or the tool bag projections 45. The docking mount 91 can also include docking tracks that are similar or identical to the tool bag tracks 40, 41 and the first end 52, second end 53, or both of each tool organizer 50 can slidably engage with either the docking tracks or the tool bag tracks 40, 41. The docking mount 91 can also include docking brackets that are similar or identical to the tool bag brackets 42 and the first end 52, second end 53, or both of each tool organizer 50 can slidably engage with either the docking brackets or the tool bag brackets 42.

In another arrangement, the docking mounts 91 can be different from the tool bag securing mounts 35. For example, if the tool bag includes tracks 40, 41, the dock mounts 91 can include projections, tracks with a different configuration, or brackets. Or if the tool bag includes projections 45, the dock mounts 91 can include projections of a different configuration, brackets or tracks. Or if the tool bag includes brackets 42, the dock mounts 91 can include projections, tracks, or brackets of a different configuration.

In some arrangements, each end of the tool organizer 50 can be adapted for attachment to a different mounting structure 40, 42, 45, 91 in a different position. For example, the first end 52 of each tool organizer 50 can slidably engage with the tool bag tracks 40/projections 45/brackets 42, and the second end 53 of each tool organizer 40 can slidably engage with the docking mount 91. In another arrangement, both the first and second ends 52, 53 of the tool organizer 50 can slidably engage with either the docking station 90 or the tool bag tracks 40/projections 45/brackets 42.

The tool storage and transport system 10 can include a tool storage and transport kit. The kit can include a tool bag body 20, at least one tool organizer 50, and at least one docking mount 91. The at least one tool organizer 50 in the kit can include an organizer tray 55. The kit can also include a tool bag body 20, at least two tool organizer 50, and at least one docking mount 91. The kit can also include a tool bag body 20, a plurality of tool organizers 50, and a plurality of docking mounts 91.

A method of storing and transporting tools is also described herein. The method can include the steps of providing a tool bag body 20 and at least one tool organizer 50 and slidably attaching the at least one tool organizer 50 into the tool bag body 20. The method can also include providing a plurality of tool organizers 50 and selecting at least one tool organizer 50 from the plurality of tool organizers 50. The tool bag body 20 can be formed from a base 25 and a plurality of exterior walls 31, 32, 33, 34 perpendicular to the base 25, and the plurality of exterior walls 31, 32, 33, 34 can include at least one securing mount 35.

Each of the tool organizers 50 can include a first end 52 and a second end 53 opposite the first end 52, and the first end 52 of each tool organizer 50 can slidably engage with at least one of the tool bag securing mounts 35 and a docking mount 91; or the first end 52 of the tool organizer 50 can slidably engage with at least one of the securing mounts 35 and the second end 53 of the tool organizer 50 can slidably engage with a docking mount 91; or the first end 52 of the tool organizer 50 can slidably engage with at least one of the securing mounts 35 and another structure on the tool organizer 50 can slidably engage with a docking mount 91.

The tool organizer 50 can be an organizer tray 55 having a bottom wall 51 and a plurality of sidewalls 54 generally perpendicular to the bottom wall 51.

The step of inserting the tool organizer 50 can include slidably engaging the first end 52 of the at least one tool organizer 50 with at least one of the plurality of securing mounts 35.

The method can also include the steps of providing at least one docking mount 91 separate from the tool bag body 20; and storing at least one tool organizer 50 at a location separated from the tool bag body 20. The storing step can include slidably engaging the at least one tool organizer 50 with the docking mount 91. The method can also include removing the at least one tool organizer 50 from a tool bag body 20 prior to slidably engaging the at least one tool organizer 50 with the docking mount 91.

The step of storing the tool organizer 50 can include slidably engaging the first end 52 of the at least one tool organizer 50 with at least one dock mount 91 or slidably engaging the second end 53 of the at least one tool organizer 50 with at least one docking mount 91. The docking mounts 91 can include a docking projection, a docking track, or a pair of docking tracks, which can be any of the projections, tracks, or pairs of tracks described herein.

The unique features of this tool storage and transport system 10 provide for improved organization and efficiency in the storage and transport of tools. The system 10 allows a user to repeatedly customize the partitions and receptacles available in a tool bag body 20 for any particular tools and/or project. The system 10 also allows quick and easy organized storage of the tool organizers 50 and any auxiliary tool receptacles 70 between the tool bag 20 and the docking stations 90. Various tool organizers 50 can be configured for specific projects, such as electrical work, plumbing, carpentry, etc. and a user can quickly and easily switch between different tool organizers as needed. Additionally, because the tool organizers 50 can include organizer trays 55, a tool organizer 50 can be removed from the tool bag body 20 at a jobsite for more efficient access to the tools stored therein. Additionally, the modular securing mounts 47 can be removed from the tool bag body 20 at a jobsite and configured to stand independently for more efficient access to the tools stored therein.

The foregoing is provided for purposes of illustrating, explaining, and describing embodiments of this invention. Modifications and adaptations to these embodiments will be apparent to those skilled in the art and may be made without departing from the scope or spirit of this invention.

What is claimed is:

1. A tool storage and transport system, comprising:

a tool bag body formed from a base, a first exterior wall perpendicular to said base, and a second exterior wall perpendicular to said base and opposite said first exterior wall; and a tool organizer slidably attachable to said tool bag body, said tool organizer comprising an organizer tray baying a bottom wall, a plurality of sidewalk generally perpendicular to said bottom wall, a first end, and a second end opposite the first end, wherein said first end slidably engages with said first exterior wall, wherein said tool bag body further comprises a modular securing mount on said first exterior wall, wherein said modular securing mount comprises a back side and a front side, wherein said front side comprises a fitted recess, wherein, when said back side faces said first exterior wall, said fitted recess engages with said first end of said tool organizer when the tool organizer is slidably attached to said tool bag body, and wherein said modular securing mount comprises at least one tool receptacle.

2. The tool storage and transport system according to claim 1, wherein said second end of said tool organizer slidably engages with said second exterior wall.

3. The tool storage and transport system according to claim 1, wherein said first exterior wall comprises at least one projection and said first end of said tool organizer comprises one or more tracks, wherein said at least one projection engages with said tracks when slidably attached to said tool bag body.

4. The tool storage and transport system according to claim 3, wherein said one or more tracks are formed by at least one vertical groove on the first end of said tool organizer corresponding to a shape of said projection.

5. The tool storage and transport system according to claim 3, wherein:

said projection comprises a generally T-shaped cross section wherein a trunk side is coupled to said exterior wall and a distal side comprises a first vertical lip and a second vertical lip spaced apart from said first vertical lip;

said one or more tracks on said tool organizer comprise a first track and a second track; and said first vertical lip is slidably engageable with said first track, and said second vertical lip is slidably engageable with said second track.

6. The tool storage and transport system according to claim 3, wherein:

said projection comprises a generally trapezoidal cross section wherein a minor side is coupled to said exterior wall and a major side comprises a first vertical lip and a second vertical lip spaced apart from said first vertical lip;

said one or more tracks on said tool organizer comprise a first track and a second track; and said first vertical lip is slidably engageable with said first track and said second vertical lip is slidably engageable with said second track.

7. The tool storage and transport system according to claim 1, wherein said modular securing mount removably attaches to said first exterior wall or removably attached to said first end of said tool organizer.

8. A The tool storage and transport system, comprising:

a tool bag body formed from a base, a first exterior wall perpendicular to said base, and a second exterior wall perpendicular to said base and opposite said first exterior wall; and a toll organizer slidably attachable to said tool bag body, said tool organizer comprising an organizer tray having a bottom wall, a plurality of sidewalls generally perpendicular to said bottom wall, a first end and a second end opposite the first end, wherein said first end slidably engages with said first exterior wall, wherein said tool bag body further comprises a modular securing mount on said first exterior wall, wherein said modular securing mount comprises a hack side and a front side, wherein said front side comprises a fitted recess, wherein, when said back side faces said first exterior wall, said fitted recess, engages with said first end of said tool organizer when the tool organizer is slidably attached to said tool bag body, and wherein said modular securing mount further comprises an adjustable fastener slidably engaged with said modular securing mount and moveable between a first attachment position, wherein a first leg projects from a back side of said modular securing mount for removable attachment to said first exterior wall, and a second attachment position, wherein a second leg projects from a front side of said modular securing mount for said removable attachment to said first end of said tool organizer.

9. The tool storage and transport system according to claim 1, wherein said organizer tray further comprises a plurality of subcompartments.

10. The tool storage and transport system according to claim 1, wherein said organizer tray further comprises at least one removable divider wall comprising a first flared edge and a second flared edge opposite said first flared edge; and first and second opposing walls selected from the group consisting of said plurality of sidewalls and one or more interior walls;

wherein said first opposing wall comprises a first facing track for slidably engaging with said first flared edge and second opposing wall comprises a second facing track for slidably engaging with said second flared edge.

11. The tool storage and transport system according to claim 10, wherein a top edge of said at least one removable divider wall comprises a flared stabilizing portion.

12. The tool storage and transport system according to claim 10, wherein said bottom wall comprises at least one pair of alignment members for receiving at least a portion of a bottom edge of said at least one removable divider wall between said pair of alignment members.

13. The tool storage and transport system according to claim 1, wherein said organizer tray further comprises additional tool receptacles selected from the group consisting of sleeves, pockets, prongs, and clips.

14. The tool storage and transport system according to claim 1, further comprising at least one auxiliary tool receptacle separate from said tool organizer and slidably attachable to at least one of said first and second exterior walls;

wherein at least one of said first and second exterior walls comprises a plurality of tracks or projections and said at least one auxiliary tool receptacle engages with at least one of said tracks or projections when slidably attached.

15. A tool storage and transport system, comprising:

a tool bag body formed from a base, a first exterior wall perpendicular to said base, and a second exterior wall perpendicular to said base and opposite said first exterior wall; and a tool organizer slidably attachable to said tool bag body, said tool organizer comprising an organizer tray having a bottom wall, a plurality of sidewalls generally perpendicular to said bottom wall, a first end, and a second end opposite the first end, wherein said first end slidably engages with said first exterior wall, wherein said tool bag body further comprises a modular securing mount on said first exterior wall, wherein said modular securing mount comprises a back side and a front side, wherein said front side comprises a fitted recess, wherein, when said back side is coupled to said first exterior wall, said fitted recess engages with said first end of said tool organizer when the tool organizer is slidably attached to said tool bag body, and wherein, when said back side is coupled to said first exterior wall, at least one tool receptacle is formed between the front side and the first exterior wall.

16. The tool storage and transport system according to claim 15, further comprising a second modular securing mount on said second exterior wall, wherein said second modular securing mount comprises a second back side and a second front side, wherein said second front side comprises a second fitted recess, wherein, when said second back side is coupled to said second exterior wall, said second fitted recess engages with said second end of said tool organizer when the tool organizer is slidably attached to said tool bag body, and wherein, when said second back side is coupled to said second exterior wall, at least one tool receptacle is formed between the second front side and the second exterior wall.

17. The tool storage and transport system according to claim 1, further comprising a second modular securing mount comprises a second back side and a second front side, wherein said second front side comprises a second fitted recess, wherein, when said second back side faces said second exterior wall, said second fitted recess engages with said second end of said tool organizer when the tool organizer is slidably attached to said tool bag body.

18. The tool storage and transport system according to claim 8, further comprising a second modular securing mount comprises a second back side and a second front side, wherein said second front side comprises a second fitted recess, wherein, when said second back side faces said second exterior wall, said second fitted recess engages with said second end of said tool organizer when the tool organizer is slidably attached to said tool bag body.

* * * * *